US007770239B1

(12) United States Patent
Goldman et al.

(10) Patent No.: US 7,770,239 B1
(45) Date of Patent: Aug. 10, 2010

(54) SUSPENSION SYSTEM AND CHIN STRAP ASSEMBLY FOR A HELMET

(75) Inventors: Marty Goldman, Virginia Beach, VA (US); Fredrick W. Storms, Jr., Newport News, VA (US); Eric M. Yeates, Virginia Beach, VA (US); Thomas A. Marx, Virginia Beach, VA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 155 days.

(21) Appl. No.: 12/079,156

(22) Filed: Mar. 25, 2008

(51) Int. Cl.
*A42B 3/00* (2006.01)
*A42B 1/22* (2006.01)
*A42B 7/00* (2006.01)

(52) U.S. Cl. ..... 2/416; 2/415; 2/417; 2/418; 2/419; 2/421

(58) Field of Classification Search ..... 2/410, 2/5, 6.1, 6.2, 6.6, 411, 412, 413, 414, 415, 2/416, 417, 418, 419, 420, 421, 422, 425; D29/102, 103
See application file for complete search history.

(56) References Cited

U.S. PATENT DOCUMENTS 2,846,683 A * 8/1958 Dye et al. ..... 2/421
3,110,900 A * 11/1963 Crowdes, Jr. ..... 2/419
3,714,668 A * 2/1973 Mirabella ..... 2/419
4,703,879 A * 11/1987 Kastendieck et al. ..... 2/422
4,884,301 A * 12/1989 Aileo ..... 2/421
5,571,080 A * 11/1996 Jensen ..... 602/56
6,085,357 A * 7/2000 Broersma ..... 2/416
6,263,511 B1 * 7/2001 Moretti ..... 2/97
6,625,814 B1 * 9/2003 Veh ..... 2/102
D518,241 S * 3/2006 Finquel ..... D29/105
7,124,449 B2 * 10/2006 Sutter et al. ..... 2/418
D537,573 S * 2/2007 Trainor et al. ..... D29/122
7,381,460 B2 * 6/2008 Palmer et al. ..... 428/304.4
2006/0010583 A1 * 1/2006 Dennis et al. ..... 2/425
2006/0096011 A1 * 5/2006 Dennis et al. ..... 2/414
2006/0179537 A1 * 8/2006 Dennis et al. ..... 2/6.6

* cited by examiner

*Primary Examiner*—Gary L Welch
*Assistant Examiner*—Jane S. Yoon
(74) *Attorney, Agent, or Firm*—Bowman Green Hampton & Kelly, PLLC

(57) ABSTRACT

A suspension system and chin strap assembly for a helmet including two downwardly extending top straps; strap adjusters coupled proximate the end portions of each top strap; a helmet attachment means coupled to each of the top straps; a headband coupled to each of the top straps; a front strap that is adjustably coupled to a first front strap adjuster and a second front strap adjuster; a nape pillow pad is coupled to the front strap, and a portion of a quick release buckle and a strap ring are slideably coupled to the front strap; a chin strap coupled to the quick release buckle and a strap ring; and a back strap that is adjustably coupled to a first back strap adjuster and a second back strap adjuster and attached to a nape pillow pad.

19 Claims, 8 Drawing Sheets

SUSPENSION SYSTEM AND CHIN STRAP ASSEMBLY FOR A HELMET

BACKGROUND OF THE INVENTION

1. Field of the Invention

This invention relates generally to a suspension system and chin strap assembly. More specifically, the present invention is directed to a suspension system and chin strap assembly for supporting and securing a helmet on a wearer's head.

2. Description of Related Art

Protective helmets are commonly worn by military and law enforcement personnel, firefighters, construction workers, rock climbers, bicyclists, motorcycle riders, skateboarders, athletes, and others to shield and/or otherwise protect their heads from impact by various objects. Protective helmets usually include an outer, protective shell comprised of an impact resistant material.

A suspension system is typically anchored within the helmet shell. The suspension system not only provides a proper and secure fit of the helmet shell to the wearer's head, but also provides a gap between the inner part of the helmet and the wearer's head and disperses and/or absorbs at least a portion of the force of an impact to the outer shell so that the full force of the impact is not transferred directly to the wearer's head.

Typical helmet suspension systems often comprise an upper support assembly, which includes crisscrossing straps attached to a headband. Certain helmet suspension systems also include a lower strap assembly that comprises a strap or other element that is designed to engage a portion of the wearer's chin and a strap or other element that is designed to engage a portion of the nape of the wearer's neck.

Pads or pillows are sometimes included as part of the headband to provide an element of cushion between the headband and the wearer's head.

SUMMARY OF THE INVENTION

Unfortunately, the upper support assembly of known helmet suspension systems is generally inconvenient to adjust to accommodate a specific wearer's head. Furthermore, the lower strap assembly of known helmet suspension systems is difficult to adjust such that the chin strap is centered relative to the wearer's chin. Typically, once the helmet is donned, the wearer must appropriately adjust multiple chin straps on either side of the wearer's head in order to center the chin strap relative to the wearer's chin.

Typically, conventional chin straps do not allow for appropriate adjustment to accommodate for a wearer's individual facial, chin, or jaw structure. In some cases, attempting to appropriately adjust a conventional strap system may be so involved that a wearer is unable to achieve a proper fit, resulting in an ill-fitting helmet that does not provide the wearer with all of the benefits the helmet is designed to supply.

Additionally, the pads or pillows used in current helmet suspension systems typically comprise a foam-based material wrapped in a moisture absorbed cover. These pads or pillows typically restrict ventilation and serve to wick up and hold moisture (moisture from perspiration, precipitation, or immersion in a fluid). The absorbed moisture is then trapped in place against the wearer's body. Being overly "wet" and poorly ventilated is not something most people enjoy or even tolerate well. This condition heightens for many people when external temperature and humidity changes and in certain temperature ranges, moisture-soaked padding can actually freeze in the later hours of the day (or overnight) not only negating their conventional benefits but also making the devices uncomfortable, unusable, and perhaps even dangerous to the wearer.

Thus, the present invention is directed to an improved suspension system and chin strap assembly for supporting and securing a helmet on a wearer's head in a manner that is superior to known helmet suspension systems.

In an illustrative, non-limiting embodiment of this invention, the suspension system and chin strap assembly includes a suspension assembly comprising two downwardly extending top straps arranged in a criss-cross or overlapping fashion. A front strap adjuster is coupled proximate the first end portion of each top strap and a back strap adjuster coupled proximate the second end portion of each top strap and a headband is coupled to each of the top straps.

Helmet attachment means are coupled to each of the top straps, such that the suspension assembly can be attached to a helmet.

A front strap is adjustably coupled between the front strap adjusters and a nape pillow pad is coupled to the front strap between the first end portion of the front strap and the second end portion of the front strap. A first end portion of a chin strap is slideably coupled to the front strap, via a quick release buckle, while a second end portion of a chin strap is slideably coupled to the front strap, via a strap ring.

A back strap is adjustably coupled between the back strap adjusters and the nape pillow pad is coupled to the back strap between the first end portion of the back strap and the second end portion of the back strap.

In various exemplary, nonlimiting embodiments, a plurality of pillow pads are included around the headband. In various exemplary embodiments, the pillow pads comprise at least one layer of a 3-D mesh material covered by a water pervious covering material. The pillow pads provide improved ventilation and do not act to wick or maintain moisture like conventional padding. By keeping the wearer's skin at a normal "wetness"/"dryness" level, the likelihood of infection or damage to the wearer's skin is reduced. Maintaining the pillow pads at a dry (or at least "drier") state can also be of benefit in areas where the external temperatures are more extreme in nature.

Through the use of the strap ring and the slidable coupling of the front strap to the quick release buckle, the improved suspension system and chin strap assembly of this invention allows the chin strap to "self-center" on the wearer's chin as tension on the front or back straps is adjusted.

Accordingly, this invention provides an improved suspension system and chin strap assembly, which has a one-buckle, self-centering chin strap.

This invention separately provides an improved suspension system and chin strap assembly, which promotes appropriate adjustment.

This invention separately provides an improved suspension system and chin strap assembly, which includes pillow pads that allow for a number of marked benefits over conventionally-employed helmet pads.

This invention separately provides an improved suspension system and chin strap assembly, which provides pillow pads that allow for improved ventilation.

This invention separately provides an improved suspension system and chin strap assembly, which provides pillow pads that allow for improved wicking of moisture.

This invention separately provides an improved suspension system and chin strap assembly, which provides pillow pads that allow for improved moisture removal.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
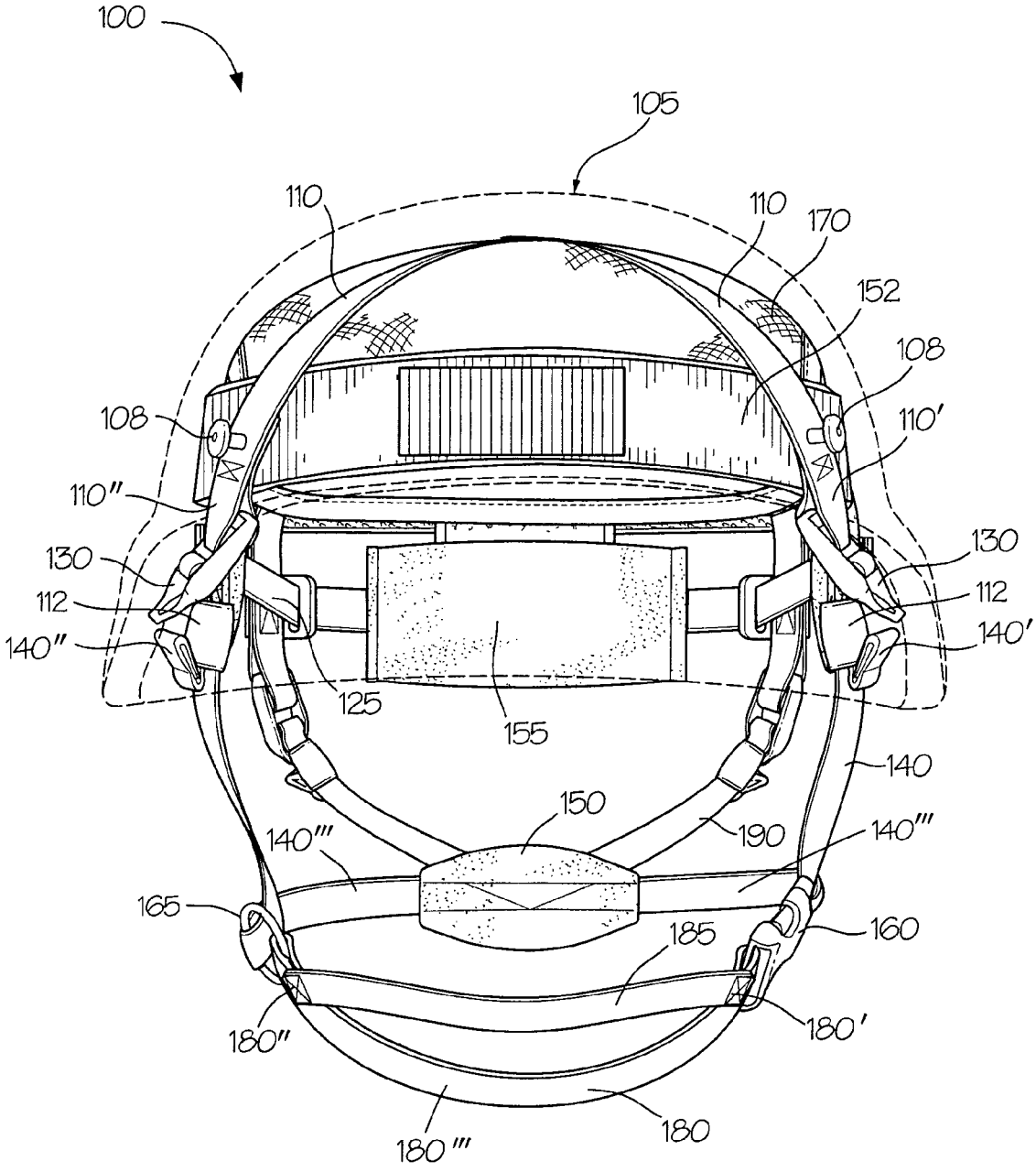
FIG. 1 shows a front view of a first exemplary embodiment of an improved suspension system and chin strap assembly according to this invention.
Figure 2A:
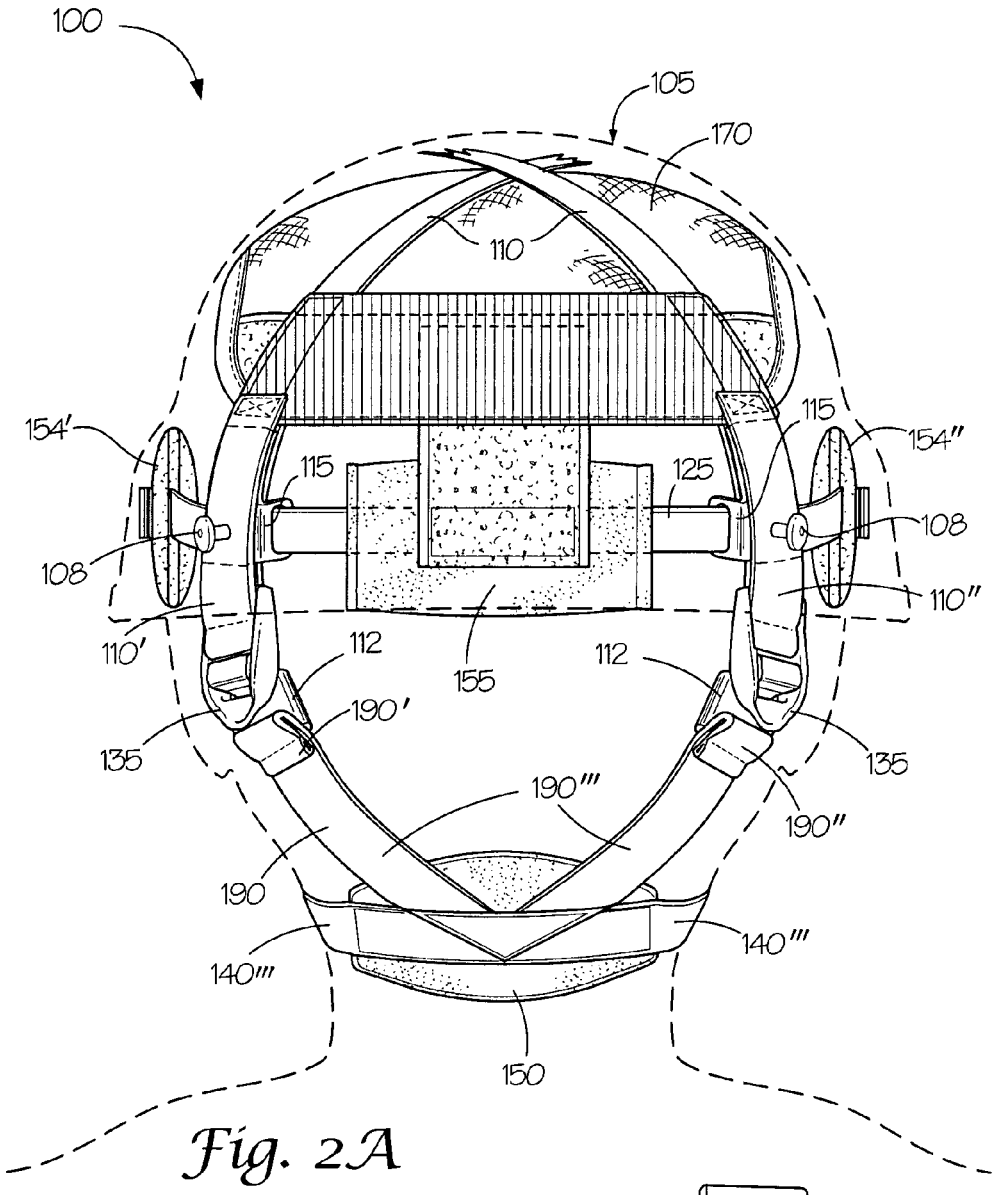
FIG. 2A shows a rear view of the first exemplary embodiment of the improved suspension system and chin strap assembly according to this invention.
Figure 2B:
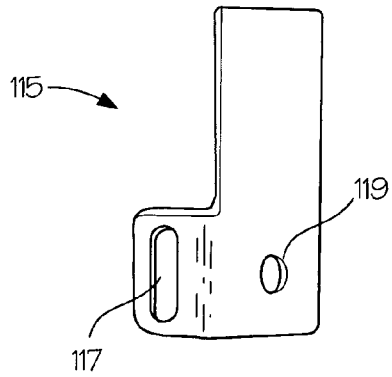
FIG. 2B shows a rear view of a L-shaped coupling bracket useable in the improved suspension system and chin strap assembly according to this invention.

For simplicity and clarification, the design factors and operating principles of the improved suspension system and thin strap assembly according to this invention are explained with reference to various exemplary embodiments of an improved suspension system and chin strap assembly according to this invention. The basic explanation of the design factors and operating principles of the improved suspension system and chin strap assembly is applicable for the understanding, design, implementation, and operation of the improved suspension system and chin strap assembly of this invention.

It should be appreciated that, for simplicity and clarification, the embodiments of this invention will be described with reference to the suspension system and chin strap assembly of this invention being implemented in a military-style helmet. However, it should be appreciated that the suspension system and chin strap assembly of this invention may be utilized as a suspension system and/or chin strap assembly in other applications. Thus, it should be appreciated that the systems, methods, and apparatuses of this invention may be implemented as a suspension system and/or chin strap assembly for any military-style helmet or as part of any other known or later developed helmet or piece of headgear.

It should also be appreciated that the term "helmet" is for a basic explanation and understanding of the operation of the systems, methods, and apparatuses of this invention. Therefore, the term "helmet" is not to be construed as limiting the systems, methods, and apparatuses of this invention.

Turning now to the drawing Figs., FIGS. 1 through 4 show a variety of views of a first exemplary, non-limiting embodiment of a suspension system and chin strap assembly 100 being implemented as part of a helmet assembly, while FIGS. 5 through 8 illustrate certain more detailed aspects of various components of the suspension system and/or chin strap assembly.

As shown in FIGS. 1 through 4, the suspension system and chin strap assembly 100 comprises at least some of top straps 110, a front headband element 120, a rear headband element 125, front strap adjusters 130, back strap adjusters 135, a front strap 140, a cap portion 170, a chin strap 180, a back strap 190, and a plurality of helmet attachment means 108 for releasably attaching the suspension system and chin strap assembly 100 to a helmet shell 105.

In various exemplary embodiments, as illustrated in FIGS. 1-6B, the top straps 110 comprise two downwardly extending portions of webbing or strap material arranged in an overlapping fashion so as to support the helmet shell 105 on the top of a wearer's head. It should be appreciated that any suitable number of straps may be used to comprise the top straps 110.

Each top strap 110 comprises a first end portion 110' and a second end portion 110". When arranged as illustrated in the drawing Figs., the first end portions 110' generally extend towards the front of the assembly, while the second end portions 110" generally extend towards the back of the assembly.

A front strap adjuster 130 is releasably or permanently attached or coupled proximate the first end portion 110' of each top strap 110 and a back strap adjuster 135 is releasably or permanently attached or coupled proximate the second end portion 110" of each top strap 110.

The front strap 140 generally comprises an elongate portion of webbing or strap material having a first end portion 140', a second end portion 140" spaced from the first end portion 140', and an intermediate portion 140"" between the first end portion 140' and the second end portion 140". The first end portion 140' of the front strap 140 is adjustably coupled to a first front strap adjuster 130 and the second end portion 140" of the front strap 140 is adjustably coupled to a second front strap adjuster 130.

The end portions 140' and 140" of the front strap 140 are adjustably coupled to the front strap adjusters 130 such that as the end portions 140' and 140" of the front strap 140 are pulled, the remaining portion of the front strap 140 is shortened, and the front strap 140 is effectively tightened.

In various exemplary embodiments, an excess portion of the front strap 140 can be releasably secured under a strap-securing element 112. In various exemplary embodiments, the strap-securing element 112 comprises a length of flexible or elastic webbing, which is attached to the front strap 140. The excess portion of the front strap 140 can be woven between the front strap 140 and the strap-securing element 112.

The nape pillow pad 150 is attached or coupled to the front strap 140 in the intermediate portion 140'", between the first end portion 140' of the front strap 140 and the second end portion 140" of the front strap 140. The nape pillow pad 150 is designed so as to be effectively centered in the nape of the wearer's head and neck area, generally in the section of the head between the occipital bone and the bottom hairline of the neck and between the hairlines on each side of the wearer's head behind the ears. In various exemplary, non-limiting embodiments of this invention, the front strap 140 is fixedly coupled in a stationary position relative to the nape pillow pad 150, via, for example, stitching. Alternatively, the front strap 140 may be slidably coupled to the nape pillow pad 150, via, for example, one or more slits or loops, a tunnel formed in the nape pillow pad 150, or hardware attachable to the nape pillow pad 150.

The chin strap 180 generally comprises an elongate portion of webbing or strap material having a first end portion 180', a second end portion 180" spaced from the first end portion 180', and an intermediate portion 180'" between the first end portion 180' and the second end portion 180". The first end portion 180' of the chin strap 180 is releasably or permanently attached or coupled to a second mating portion of the quick release buckle 160 and the second end portion 180" of the chin strap 180 is releasably or permanently attached or coupled to a strap ring 165.

In various exemplary embodiments, the chin strap 180 also includes a secondary chin strap 185. The secondary chin strap 185 extends from the chin strap 180 to provide additional support for the wearers chin. Typically, the combination of the chin strap 180 and the secondary chin strap 185 allows the chin strap to effectively engage both an upper portion and a lower portion of the wearers chin.

It should also be appreciated that the chin strap 180 may comprise a single stitched or molded, substantially cup-shaped unit that is designed to specifically accommodate a wearers chin.

Figure 4:
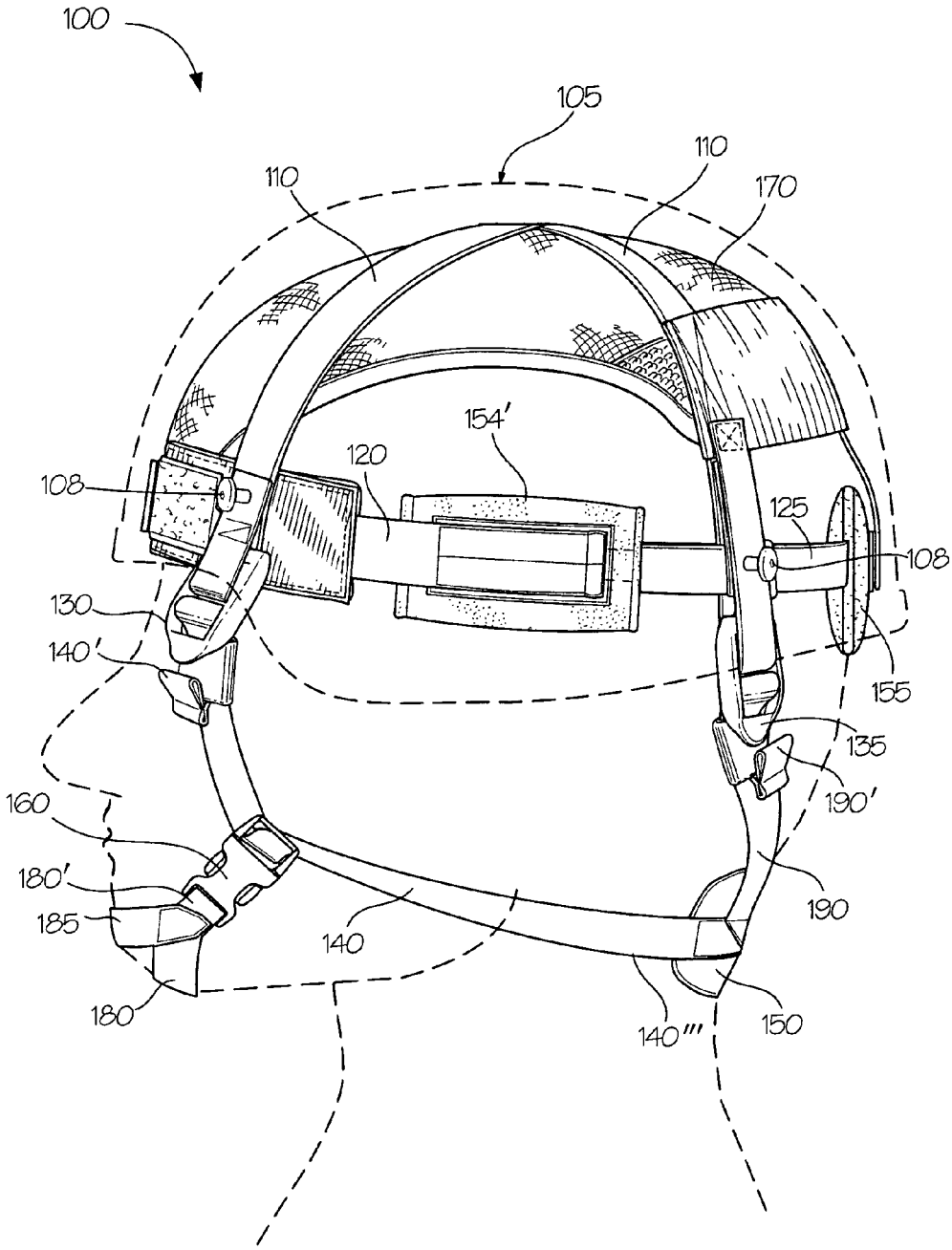
FIG. 4 shows a left side view of the first exemplary embodiment of the improved suspension system and chin strap assembly according to this invention.

As illustrated in FIGS. 1 and 4, a first mating portion of a quick release buckle 160 is slideably coupled to the front strap 140 between the first end portion 140' of the front strap 140 and the nape pillow pad 150. The quick release buckle 160 comprises a mating pair of coupling elements, a first mating portion, and a corresponding second mating portion. As illustrated, the first mating portion and the second mating portion may be releasably coupled together.

As shown in FIG. 1, and as shown in greater detail in FIG. 4, the front strap 140 slidably engages the first mating portion of the quick release buckle 160, such that the first mating portion is slidable along the front strap 140. The second mating portion is attached or coupled to the chin strap 180. Thus, when the first mating portion is coupled to the second mating portion, the chin strap 180 is releasably, slidably coupled to the front strap 140.

Figure 3:
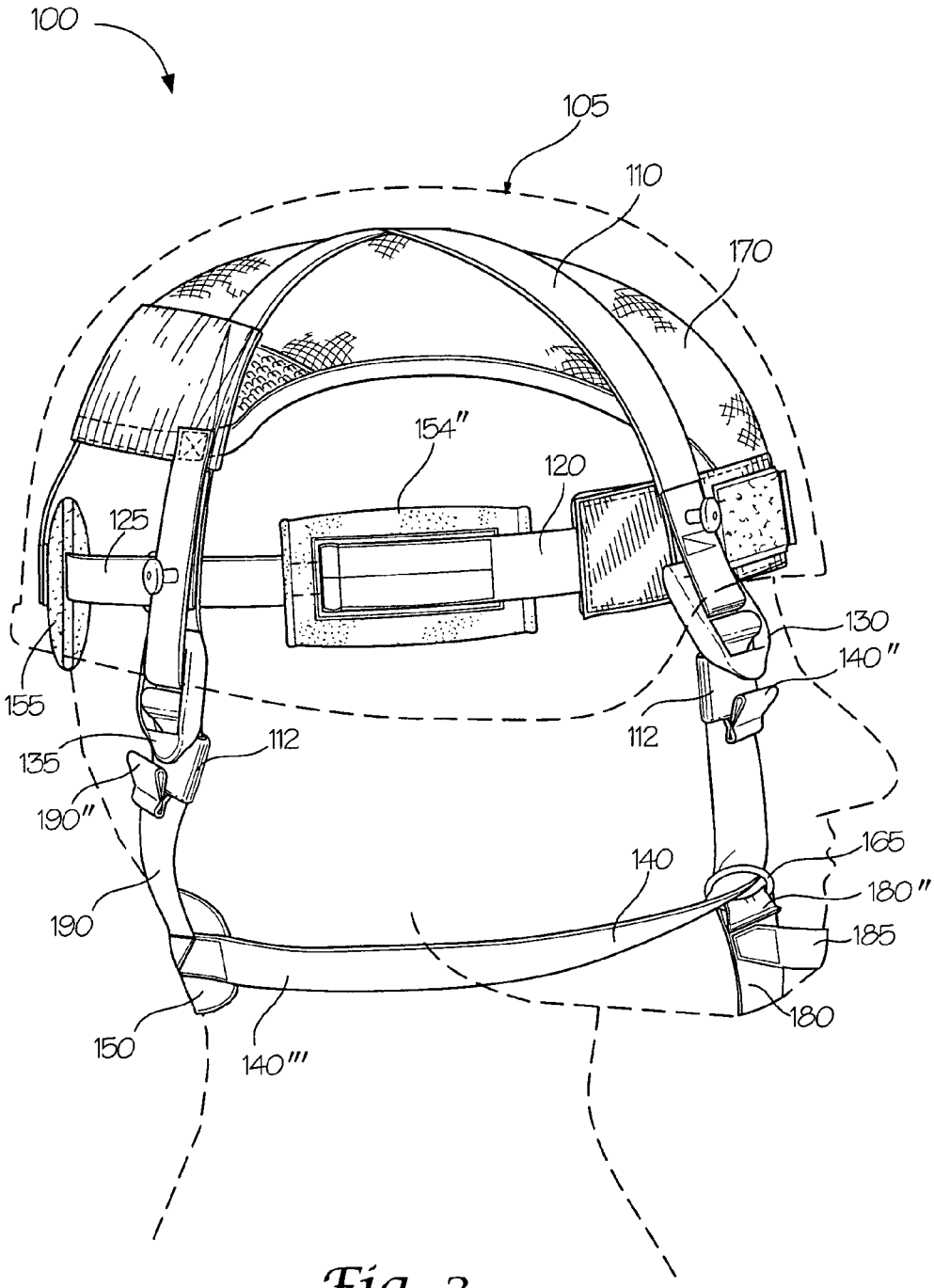
FIG. 3 shows a right side view of the first exemplary embodiment of the improved suspension system and chin strap assembly according to this invention.
Figure 5:
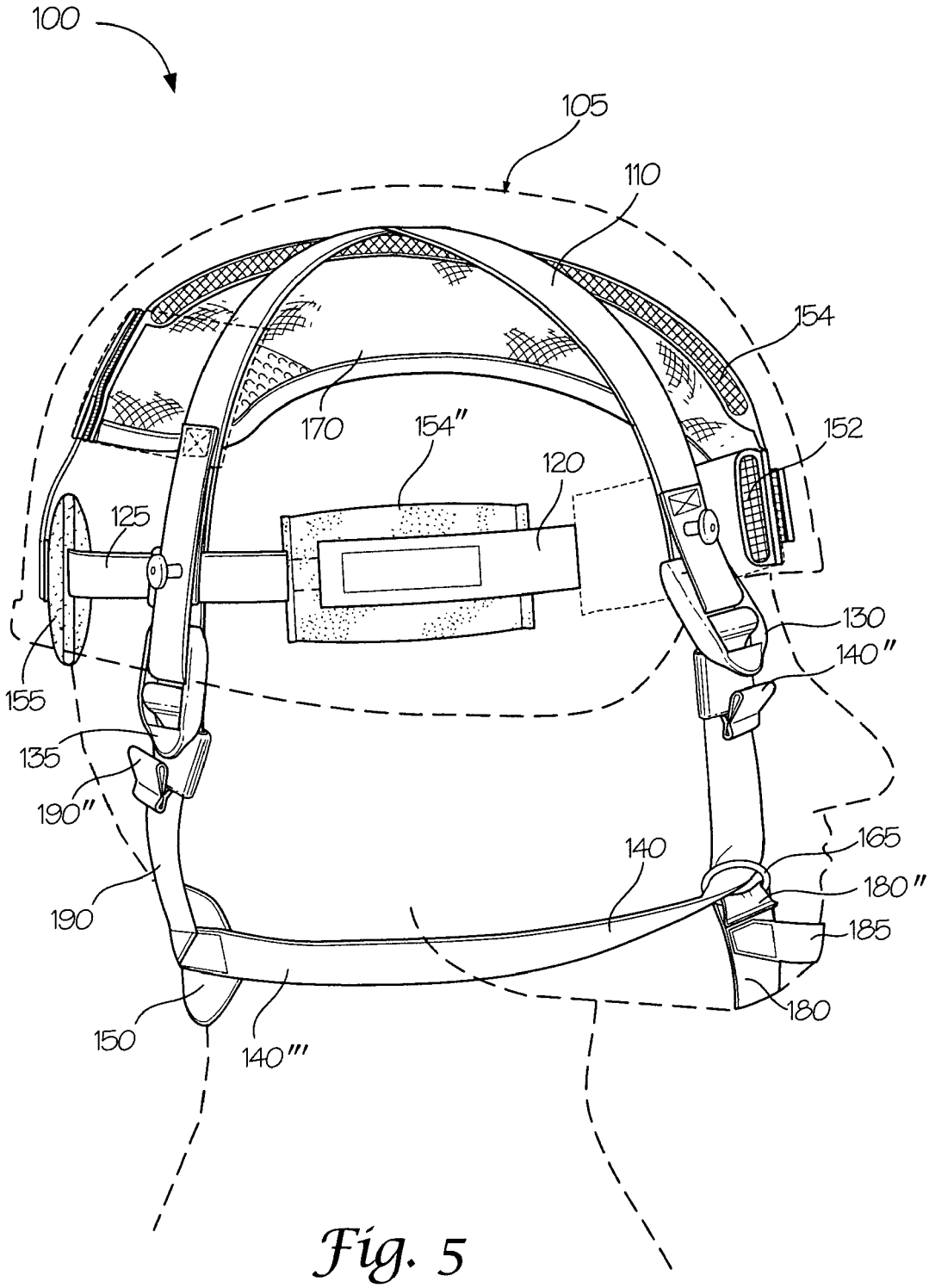
FIG. 5 shows a partial cutaway right side view of the first exemplary embodiment of the improved suspension system and chin strap assembly, illustrating the detail if the interior of the optional padding of the cap and pillow pad according to this invention.
Figure 6A:
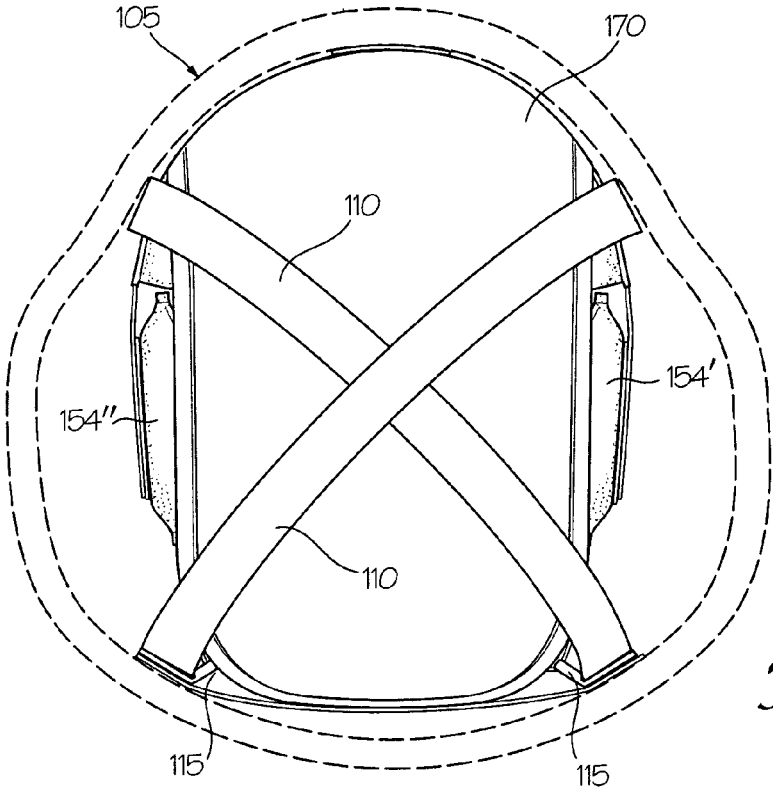
FIG. 6A shows a top view of the first exemplary embodiment of the improved suspension system according to this invention.
Figure 6B:
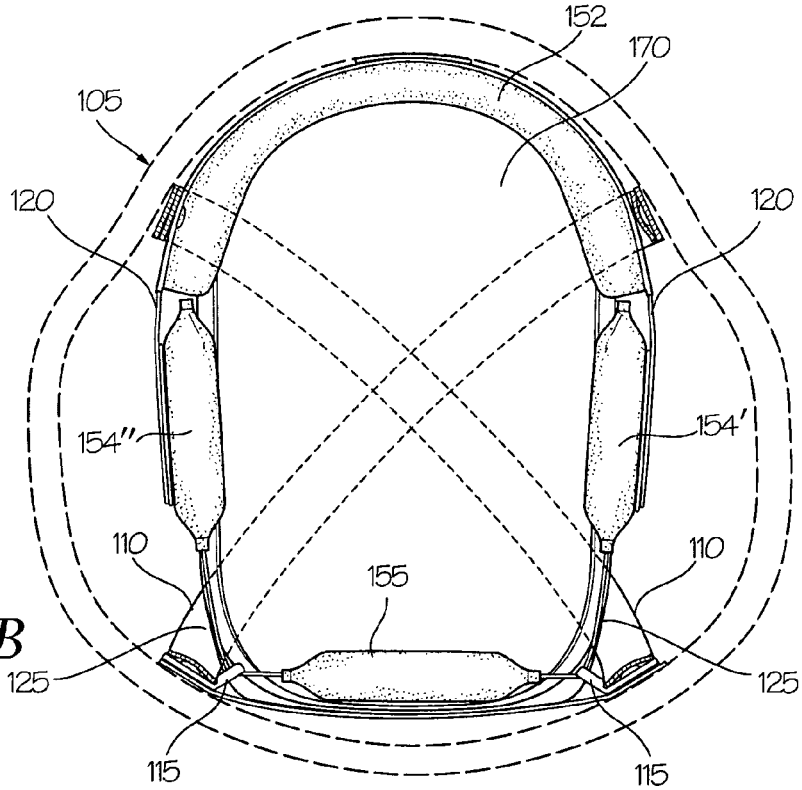
FIG. 6B shows a bottom view of the first exemplary embodiment of the improved suspension system according to this invention.

As illustrated in FIGS. 1, 3 and 5, the strap ring 165 is slideably coupled to the front strap 140 between the second end portion 140" of the front strap 140 and the nape pillow pad 150. In various exemplary embodiments, the strap ring 165 comprises a generally circular loop. However, it should be appreciated that the strap for a 165 may comprise any suitable shape, so long as the strap ring 165 is capable of being slidable along the front strap 140.

Thus, the chin strap 180 is effectively suspended between two points along the front strap 140, via the quick release buckle 160 and the strap ring 165. When the first mating portion and the second mating portion of the quick release buckle 160 are coupled together, the chin strap 180 is releasably, slidably coupled to the front strap 140, such that the position of the chin strap 180 relative to the front strap 140 is infinitely slidably adjustable to accommodate the particular wearer's chin. Furthermore, the quick release buckle 160 allows the chin strap 180 to be quickly and easily detached from the front strap 140, such that the wearer may quickly disconnect the chin strap 180 from the front strap 140 to remove the helmet, if desired.

The back strap 190 generally comprises an elongate portion of webbing or strap material having a first end portion 190', a second end portion 190" spaced from the first end portion 190', and an intermediate portion 190'" between the first end portion 190' and the second end portion 190". The first end portion 190' of the back strap 190 is adjustably coupled to a first back strap adjuster 135 and the second end portion 190" of the back strap 190 is adjustably coupled to a second back strap adjuster 135.

The end portions 190' and 190" of the back strap 190 are adjustably coupled to the back strap adjusters 135 such that as the end portions 190' and 190" of the back strap 190 are pulled, the remaining portion of the back strap 190 is shortened, and the back strap 190 is effectively tightened.

In various exemplary embodiments, an excess portion of the back strap 190 can be releasably secured under a strap-securing element 112. In various exemplary embodiments, the strap-securing element 112 comprises a length of flexible or elastic webbing, which is attached to the back strap 190. The excess portion of the back strap 190 can be woven between the back strap 190 and the strap-securing element 112.

The nape pillow pad 150 is attached or coupled to the back strap 190 in the intermediate portion 190'", between the first end portion 190' of the back strap 190 and the second end portion 190" of the back strap 190. In various exemplary, non-limiting embodiments of this invention, the back strap 190 is fixedly coupled in a stationary position relative to the nape pillow pad 150, via, for example, stitching. Alternatively, the back strap 190 may be slidably coupled to the nape pillow pad 150, via, for example, one or more slits or loops, a tunnel formed in the nape pillow pad 150, or hardware attachable to the nape pillow pad 150.

In various exemplary embodiments, the headband includes two elongate portions of webbing or strap material comprising a front headband element 120 and a rear headband element 125. The front headband element 120 is secured to the portion of the top straps 110 that extends toward the front of the assembly (the front of the wearer's head) and extends back, from the front of the assembly, toward the back of the assembly. The rear headband element 125 is secured to the portion of the top straps 110 that extends toward the back of the assembly (the back of the wearer's head) and extends foreword, from the back of the assembly, toward the front of the assembly.

In various exemplary embodiments, the front headband element 120 and/or the rear headband element 125 is coupled to at least one of the top straps 110 via an L-shaped coupling bracket 115. As illustrated most clearly in FIGS. 2A and 2B, the L-shaped coupling bracket 115 includes a slot 117 and an aperture 119. The slot 117 is formed so as to allow the front headband element 120 or the rear headband element 125 to pass therethrough. The aperture 119 is formed so as to allow at least a portion of the helmet attachment means 108 to pass therethrough.

In various exemplary embodiments, at least a portion of the L-shaped coupling bracket 115 is secured within a portion of the top strap 110. It should be appreciated that the L-shaped coupling bracket 115 may be secured within or to a portion of the top strap 110 via, for example, an adhesive or stitching.

Typically, the front headband element 120 and the rear headband element 125 are positioned such that when the suspension system and chin strap assembly 100 is positioned on the wearer's head, the front headband element 120 and the rear headband element 125 encircle the wearer's head at a position between the wearer's parietal ridge and ears.

In various exemplary embodiments, the end portions of the front headband element 120 and the end portions of the rear headband element 125 include mating portions of overlapping hook-and-loop fasteners, such that the end portions of the front headband element 120 may be removably, adjustably secured to the end portions of the rear headband element 125. In this manner, the effective circumference of the combined front headband element 120 and rear headband element 125 can be adjusted to accommodate the circumference of the wearer's head. Alternatively, as illustrated in FIGS. 1 through 6B, if a left side pillow pad 154' and a right side pillow pad 154" are included at the end portion of the rear headband element 125, mating portions of overlapping hook-and-loop fasteners may be included on the pillow pads 154' and 154" and the end portions of the front headband element 120 such that the end portions of the front headband element 120 may be removably, adjustably secured to the pillow pads 154' and 154" at the end portions of the rear headband element 125. Likewise, while not illustrated herein, it should be appreciated that if a left side pillow pad 154' and a right side pillow pad 154" are included at the end portion of the front headband element 120, mating portions of overlapping hook-and-loop fasteners may be included on the pillow pads 154' and 154" and the end portions of the rear headband element 125 such that the end portions of the rear headband element 125 may be removably, adjustably secured to the pillow pads 154' and 154" at the end portions of the front headband element 120.

It should be appreciated that each of the various straps or strap-like components of the suspension system and chin strap assembly 100, including, the top straps 110, the front headband element 120, the rear headband element 125, the front strap 140, the chin strap 180, the secondary chin strap 185, and the back strap 190, may be of a predetermined, substantially non-elastic length of material. Alternatively, these components may comprise a substantially flexible or elastic material or include a flexible or elastic portion to allow for a measure of expansion of the given components.

Figure 7A:
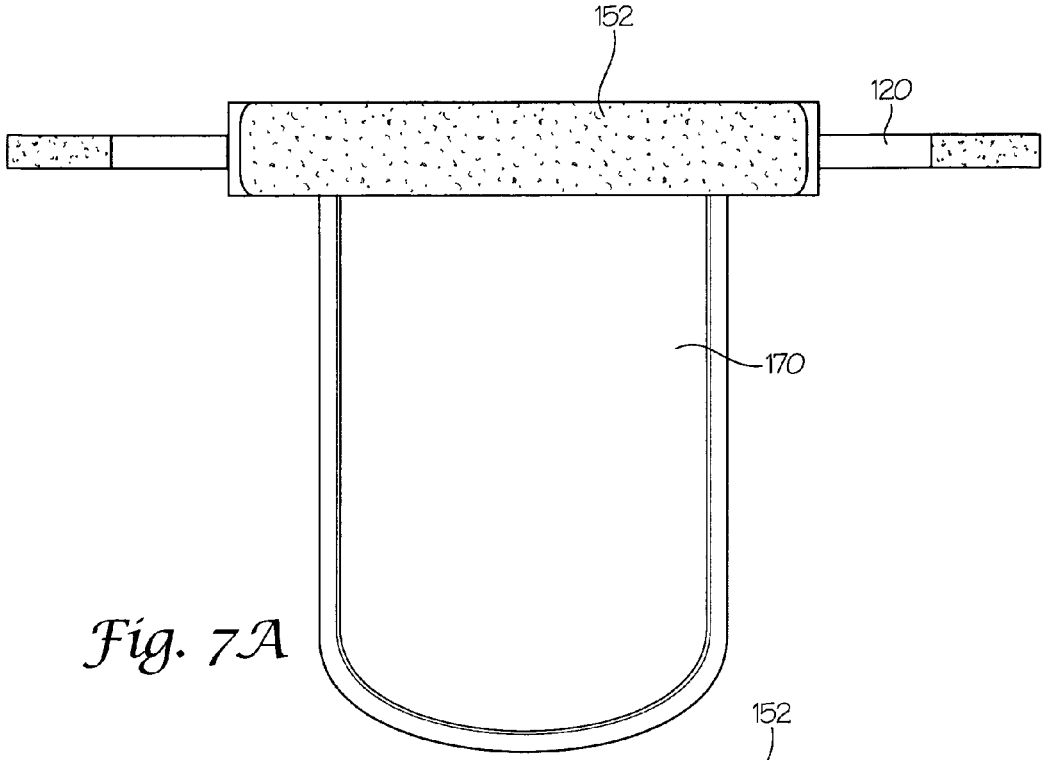
FIG. 7A shows a bottom view of the cap, wherein the cap is separated from the remaining components of the improved suspension system according to this invention.
Figure 7B:
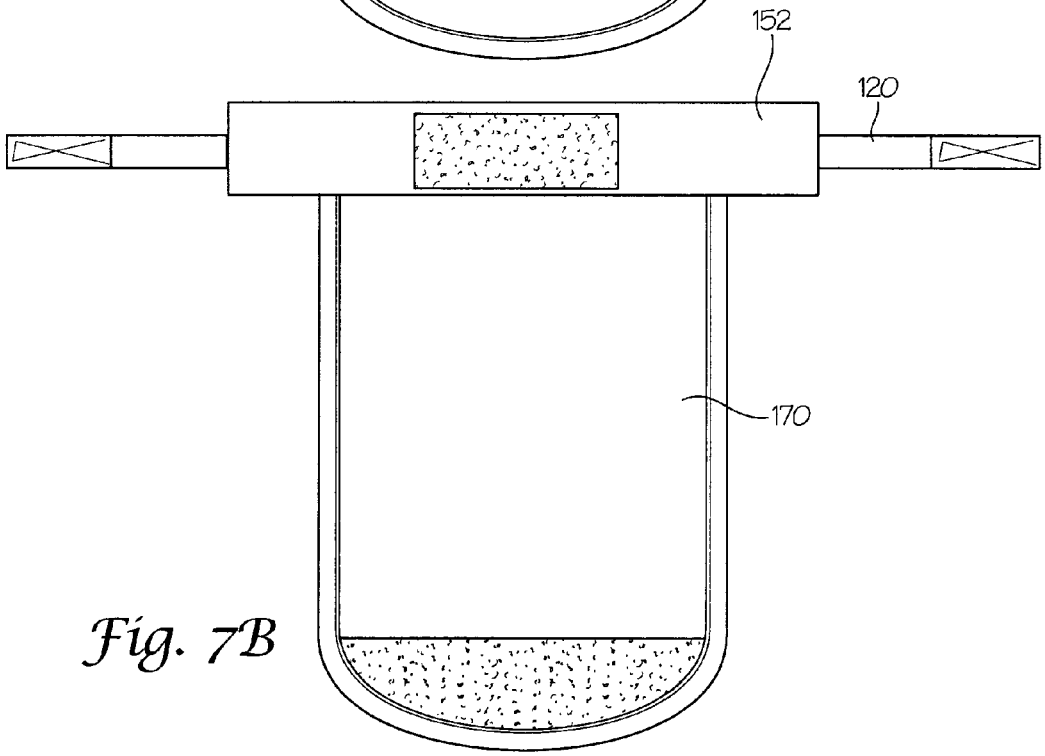
FIG. 7B shows a top view of the cap, wherein the cap is separated from the remaining components of the improved suspension system according to this invention.

As illustrated in FIGS. 7A and 7B, the cap portion 170 comprises a portion of material that is permanently or removably attached or coupled to the front headband element 120. As illustrated most clearly in FIGS. 1 through 5, the cap portion 170 extends back, from the front of the assembly, toward the back of the assembly. In various exemplary embodiments, the cap 170 extends back to cover the wearer's crown, or the area at the upper back of the wearer's skull, where the cap portion 170 is permanently or removably attached or coupled to at least a portion of the top straps 110. In certain exemplary embodiments, a portion of the cap portion 170 extends to the back of the assembly, where it is permanently or removably attached or coupled to a portion of the rear headband element 125 (or a rear pillow pad 155). The cap portion 170 is capable of providing a level of cushion between a wearer's head and at least a portion of the top straps 110.

A number of pillow pads may be included in the suspension system and chin strap assembly 100, and particularly in the suspension system portion of the suspension system and chin strap assembly 100. For example, a front pillow pad 152 may be permanently or removably attached or coupled to a portion of the front headband element 120 and/or the cap portion 170, a left side pillow pad 154' and a right side pillow pad 154" may be permanently or removably attached or coupled to an end portion of the front headband element 120 or the rear headband element 125, a rear pillow pad 155 may be permanently or removably attached or coupled to a portion of the rear headband element 125, and/or a cap pillow pad 156 may be permanently or removably attached or coupled to a portion of the cap portion 170 are formed as an integral part of the cap portion 170.

Figure 8:
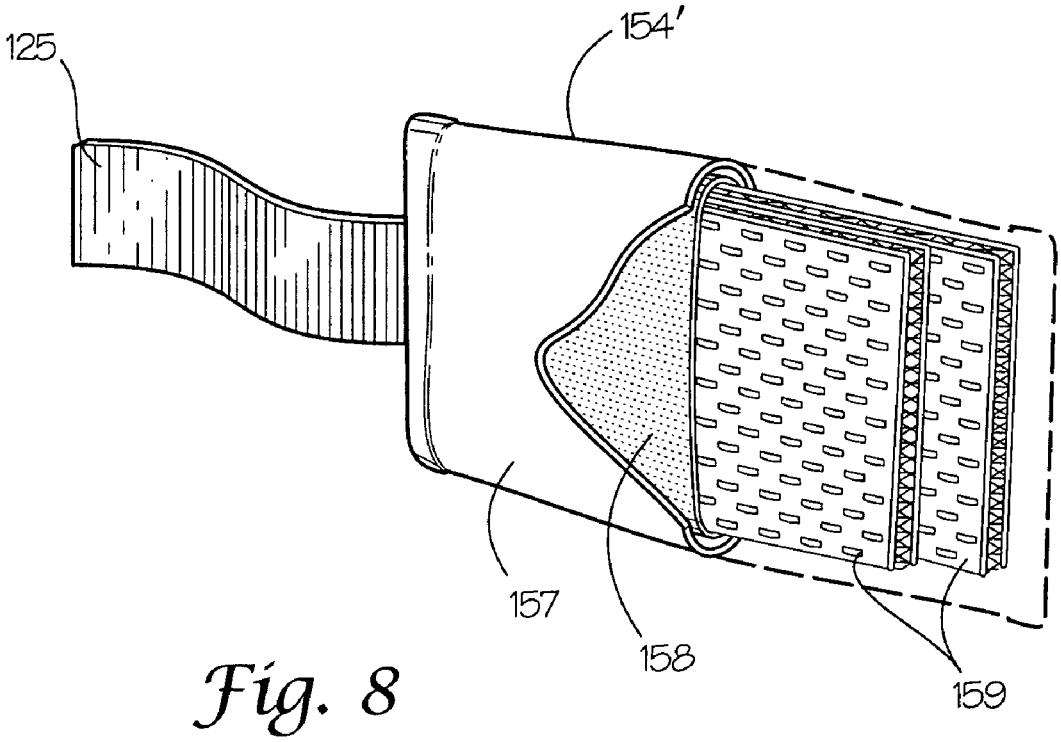
FIG. 8 shows more detailed, cutaway perspective view of an exemplary pillow pad according to this invention.

FIG. 8 shows more detailed, cutaway perspective view of an exemplary embodiment of the left side pillow pad 154'. As illustrated in FIG. 8, the pillow pad 154' includes a covering material 157, an intermediate layer 158, and one or more layers of 3-D mesh 159. In certain embodiments, the covering material 157 comprises a material having certain water pervious comment on melting, or fire/flame retardant properties, such as, for example, Nomex®. However, it should be appreciated that the specific material chosen for the covering material 157 is a design choice based on the desired appearance and functionality of the covering material 157 and the pillow pad 154'.

The one or more layers of 3-D mesh 159 provide a number of marked benefits when compared to conventionally-employed foam or other padding materials. For example, the 3-D mesh 159 provides superior ventilation properties to the pillow pad 154'. Additionally, the 3-D mesh 159 allows moisture created by perspiration to move away from the body side of the pillow pad 154' and not be trapped in place or against the body side, as is generally seen with other foams and padding materials. Even when wicking is not optimized, the 3-D mesh 159 does not act like a blotter or sponge to soak up either perspiration or environmentally induced moisture, as do other foams and types of padding. Even under the worst of conditions—where the wearer might wish to "wring" things out, the 3-D mesh 159 will not contain (before wringing) or retain (after wringing) as much moisture as conventional foams and padding materials. Furthermore, due to the nature of the 3-D mesh 159, and by maintaining the pillow pads in a relatively dry state, the shock absorbing properties of the 3-D mesh 159, and therefore the pillow pad 154', is not compromised.

In various exemplary embodiments, an intermediate layer of material 158 is included, which separates the one or more layers of 3-D mesh material 159 from the covering material 157.

It should be appreciated that while FIG. 8 illustrates pillow pad 154', in any given embodiment, one or more of the pillow pads 150, 152, 154, 154', 154", 155, and/or 156 may comprise the elements illustrated in FIG. 8.

When assembled, the suspension system and chin strap assembly 100 is coupled within the helmet shell 105, via a plurality of helmet attachment means 108. In various exemplary embodiments, the attachment means 108 comprise a threaded attachment device, buttons, snaps, or other known or later developed attachment means.

As illustrated, the helmet shell attachment means 108 are attached or coupled to each of the top straps 110 such that the suspension assembly is attached within the helmet shell 105. In the illustrated embodiment, one helmet shell attachment means 108 corresponds to each top strap 110 in order to connect the 20 top straps 110 to the helmet shell 105.

In order for the wearer to properly position the helmet shell 105 on the wearer's head, the front strap adjusters 130 and the back strap adjusters 135 are manipulated such that the front strap 140 and the back strap 190 are released. The helmet shell 105 is positioned squarely on the wearer's head and adjusted such that the rim of the helmet shell 105 is approximately one finger's thickness above the wearer's eyebrow line.

Once the helmet shell 105 has been positioned appropriately, the attachment of the end portions of the front headband element 120 and the end portions of the rear headband element 125 (or the end portion of the headband element and the respective pillow pad 154' or 154") are appropriately adjusted and secured to accommodate the circumference of the wearer's head. Once the headband elements are adjusted, the chin strap 180 is appropriately positioned on or around the users chin and the mating portions of the quick release buckle 160 are attached. Then, the end portions 140' and/or 140" of the front strap 140 are pulled to appropriately tighten the front strap 140. As the end portions 140' and/or 140" are pulled and the front strap 140 is tightened, the chin strap 180 is able to maintain its position on or around the users chin, because of the slidable connection of the chin strap 180 and the front strap 140. Finally, the end portions 190' and/or 190" of the back strap 190 are pulled to appropriately tighten the back strap 190.

While this invention has been described in conjunction with the exemplary embodiments outlined above, it is evident that this invention is not limited to particular variations set forth and many alternatives, adaptations, modifications, and variations will be apparent to those skilled in the art. Such alternatives, adaptations, modifications, and variations should and are intended to be comprehended within the meaning and range of equivalents of the disclosed exemplary embodiments and may be substituted without departing from the true spirit and scope of the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

Also, it is contemplated that any optional feature of the inventive variations described herein may be set forth and claimed independently, or in combination with any one or more of the features described herein.

Accordingly, the foregoing description of the exemplary embodiments of the invention, as set forth above, are intended to be illustrative, not limiting.

Various changes, modifications, and/or adaptations may be made without departing from the spirit and scope of this invention.

What is claimed is:

1. A suspension system and chin strap assembly for a helmet, comprising:

two downwardly extending top straps arranged in an overlapping fashion, wherein each top strap comprises a first end portion and a second end portion;

a front strap adjuster coupled proximate the first end portion of each top strap and a back strap adjuster coupled proximate the second end portion of each top strap;

a helmet attachment means coupled to each of the top straps, wherein each helmet attachment means is capable of attaching the suspension assembly to a helmet;

a headband coupled to each of the top straps, wherein the headband is coupled to at least one of the top straps via an L-shaped coupling bracket;

a front strap, wherein the front strap has a first end portion, a second end portion spaced from the first end portion, and an intermediate portion between the first end portion and the second end portion; wherein the first end portion of the front strap is adjustably coupled to a first front strap adjuster and the second end portion of the front strap is adjustably coupled to a second front strap adjuster; wherein a nape pillow pad is coupled to the front strap between the first end portion of the front strap and the second end portion of the front strap; wherein a first mating portion of a quick release buckle is slideably coupled to the front strap between the first end portion of the front strap and the nape pillow pad; and wherein a strap ring is slideably coupled to the front strap between the second end portion of the front strap and the nape pillow pad;

a chin strap, wherein the chin strap has a first end portion, a second end portion spaced from the first end portion, and an intermediate portion between the first end portion and the second end portion; wherein the first end portion of the chin strap is coupled to a second mating portion of the quick release buckle and the second end portion of the chin strap is coupled to the strap ring;

a back strap, wherein the back strap has a first end portion, a second end portion spaced from the first end portion, and an intermediate portion between the first end portion and the second end portion; wherein the first end portion of the back strap is adjustably coupled to a first back strap adjuster and the second end portion of the back strap is adjustably coupled to a second back strap adjuster; and wherein the back strap is coupled to the nape pillow pad between the first end portion of the back strap and the second end portion of the back strap.

2. The suspension system and chin strap assembly of claim 1, wherein the nape pillow pad is slideably coupled to the front strap between the first end portion of the front strap and the second end portion of the front strap.

3. The suspension system and chin strap assembly of claim 1, wherein the nape pillow pad is fixedly coupled to the front strap between the first end portion of the front strap and the second end portion of the front strap.

4. The suspension system and chin strap assembly of claim 1, wherein the nape pillow pad comprises at least one layer of a 3-D mesh material covered by a water pervious covering material.

5. The suspension system and chin strap assembly of claim 1, wherein the back strap is slideably coupled to the nape pillow pad between the first end portion of the back strap and the second end portion of the back strap.

6. The suspension system and chin strap assembly of claim 1, wherein the back strap is fixedly coupled to the nape pillow pad between the first end portion of the back strap and the second end portion of the back strap.

7. The suspension system and chin strap assembly of claim 1, wherein the chin strap portion comprises a secondary chin strap portion.

8. The suspension system and chin strap assembly of claim 1, wherein the headband comprises a front headband element and a rear headband element, wherein the front headband element and the rear headband element are adjustably coupled together.

9. The suspension system and chin strap assembly of claim 8, wherein a cap portion is attached to the front headband element and at least a portion of the top straps, wherein the cap portion is capable of providing a level of cushion between a wearer's head and at least a portion of the top straps.

10. The suspension system and chin strap assembly of claim 9, wherein a cap portion is attached to the rear headband element.

11. The suspension system and chin strap assembly of claim 10, wherein each pillow pad comprises at least one layer of a 3-D mesh material covered by a water pervious covering material.

12. The suspension system and chin strap assembly of claim 10, wherein each pillow pad comprises a plurality of layers of a 3-D mesh material covered by a water pervious covering material.

13. The suspension system and chin strap assembly of claim 8, wherein the front headband element is attached to a pillow pad at each end of the front headband element and wherein the rear headband element is adjustably coupled to the one or more pillow pads.

14. The suspension system and chin strap assembly of claim 8, wherein the rear headband element is attached to one or more pillow pads at each end of the rear headband element and wherein the front headband element is adjustably coupled to the one or more pillow pads.

15. The suspension system and chin strap assembly of claim 8, wherein the front headband element is attached to one or more pillow pads.

16. The suspension system and chin strap assembly of claim 8, wherein the rear headband element is attached to one or more pillow pads.

17. The suspension system and chin strap assembly of claim 1, further comprising a plurality of pillow pads attached to the headband.

18. The suspension system and chin strap assembly of claim 1, wherein the strap ring comprises a generally circular loop.

19. A helmet comprising:

a helmet having an inner surface and an outer surface opposite the inner surface;

a suspension system and chin strap assembly removably attached to the helmet, wherein the suspension system and chin strap assembly comprises:

two downwardly extending top straps arranged in an overlapping fashion, wherein each top strap comprises a first end portion and a second end portion;

a front strap adjuster coupled proximate the first end portion of each top strap and a back strap adjuster coupled proximate the second end portion of each top strap;

a helmet attachment means coupled to each of the top straps, wherein each helmet attachment means is attached to the helmet;

a headband coupled to each of the top straps, wherein the headband is coupled to at least one of the top straps via an L-shaped coupling bracket;

a front strap, wherein the front strap has a first end portion, a second end portion spaced from the first end portion, and an intermediate portion between the first end portion and the second end portion; wherein the first end portion of the front strap is adjustably coupled to a first front strap adjuster and the second end portion of the front strap is adjustably coupled to a second front strap adjuster; wherein a nape pillow pad is coupled to the front strap between the first end portion of the front strap and the second end portion of the front strap; wherein a first mating portion of a quick release buckle is slideably coupled to the front strap between the first end portion of the front strap and the nape pillow pad; and wherein a strap ring is slideably coupled to the front strap between the second end portion of the front strap and the nape pillow pad;

a chin strap, wherein the chin strap has a first end portion, a second end portion spaced from the first end portion, and an intermediate portion between the first end portion and the second end portion; wherein the first end portion of the chin strap is coupled to a second mating portion of the quick release buckle and the second end portion of the chin strap is coupled to the strap ring;

a back strap, wherein the back strap has a first end portion, a second end portion spaced from the first end portion, and an intermediate portion between the first end portion and the second end portion; wherein the first end portion of the back strap is adjustably coupled to a first back strap adjuster and the second end portion of the back strap is adjustably coupled to a second back strap adjuster; and wherein the back strap is coupled to the nape pillow pad between the first end portion of the back strap and the second end portion of the back strap.

* * * * *